US007770649B2

(12) United States Patent
Biester et al.

(10) Patent No.: US 7,770,649 B2
(45) Date of Patent: Aug. 10, 2010

(54) LOCKING DEVICE

(75) Inventors: Klaus Biester, Wienhausen (DE); Norbert Lenz, Celle (DE)

(73) Assignee: Cameron International Corporation, Houston, TX (US)

( * ) Notice: Subject to any disclaimer, the term of this patent is extended or adjusted under 35 U.S.C. 154(b) by 9 days.

(21) Appl. No.: 11/577,020

(22) PCT Filed: Oct. 12, 2004

(86) PCT No.: PCT/EP2004/011426

§ 371 (c)(1),
(2), (4) Date: Apr. 11, 2007

(87) PCT Pub. No.: WO2006/039937

PCT Pub. Date: Apr. 20, 2006

(65) Prior Publication Data

US 2008/0000275 A1 Jan. 3, 2008

(51) Int. Cl.
*E21B 23/00* (2006.01)

(52) U.S. Cl. ..... 166/338; 166/339; 166/340; 166/341; 166/344; 166/351; 166/368; 166/381

(58) Field of Classification Search ..... 166/338–341, 166/344, 350, 351, 367, 368
See application file for complete search history.

(56) References Cited

U.S. PATENT DOCUMENTS 906,217 A * 12/1908 Gaylord ..... 285/391
1,325,468 A * 12/1919 Foster ..... 285/88
1,499,063 A * 6/1924 Kraft ..... 285/15
1,507,877 A * 9/1924 Wilson ..... 285/391
1,539,287 A * 5/1925 Wilson ..... 285/333
1,605,315 A * 11/1926 Wilson ..... 285/334
1,645,032 A * 10/1927 Wilson ..... 285/27
1,671,458 A * 5/1928 Wilson ..... 403/343
1,831,956 A * 11/1931 Harrington ..... 277/326
2,664,918 A * 1/1954 Hamer ..... 138/94.3

(Continued)

FOREIGN PATENT DOCUMENTS

FR 2664627 1/1992

(Continued)

OTHER PUBLICATIONS

International Search Report for Appl. No. PCT/EP2004/011426 dated Jun. 20, 2005; (5 p.).

*Primary Examiner*—Thomas A Beach
*Assistant Examiner*—Matthew R Buck
(74) *Attorney, Agent, or Firm*—Conley Rose, P.C.

(57) ABSTRACT

A locking device for locking an exchangeable unit in an insertion opening of an associated housing, particular in maritime mineral oil or mineral gas extraction, comprises locking elements adjustable between an insertion opening and a locking position, wherein in its insertion direction the unit can be inserted into the insertion opening, and is locked in the locking position within the insertion opening and relative to the housing. The locking elements are formed as thread segments spaced apart by insertion gaps in the circumferential direction and arranged on the outer side of the unit and being aligned with the insertion opening, said thread segments being arranged in the insertion opening at a gap and being in thread engagement in the locking position.

24 Claims, 3 Drawing Sheets

U.S. PATENT DOCUMENTS

| | | | | | |
|---|---|---|---|---|---|
| 2,673,751 | A | * | 3/1954 | Finch | 285/84 |
| 3,239,245 | A | * | 3/1966 | Press et al. | 285/18 |
| 3,421,580 | A | * | 1/1969 | Fowler et al. | 166/336 |
| 3,442,536 | A | * | 5/1969 | Fowler | 285/27 |
| 3,540,762 | A | * | 11/1970 | Dunlap | 285/391 |
| 3,656,501 | A | * | 4/1972 | Buchta | 137/315.29 |
| 3,800,869 | A | * | 4/1974 | Herd et al. | 166/337 |
| 3,895,829 | A | * | 7/1975 | Manson, Jr. | 285/3 |
| 3,922,009 | A | * | 11/1975 | Giebeler | 285/87 |
| 3,948,545 | A | * | 4/1976 | Bonds | 285/4 |
| 3,971,576 | A | * | 7/1976 | Herd et al. | 285/87 |
| 3,999,782 | A | * | 12/1976 | Shotbolt et al. | 285/18 |
| 4,185,856 | A | * | 1/1980 | McCaskill | 285/18 |
| 4,330,140 | A | * | 5/1982 | Hampton | 285/39 |
| 4,795,198 | A | * | 1/1989 | Hjelset | 285/32 |
| 5,129,417 | A | * | 7/1992 | Dupont et al. | 137/315.26 |
| 5,224,653 | A | * | 7/1993 | Nelson et al. | 239/222.17 |
| 5,224,829 | A | * | 7/1993 | Horvei | 137/315.2 |
| 5,403,043 | A | * | 4/1995 | Smet | 285/39 |
| 6,283,511 | B1 | * | 9/2001 | Kamp | 285/391 |
| 6,764,110 | B2 | * | 7/2004 | Russell | 285/381.1 |
| 7,380,590 | B2 | * | 6/2008 | Hughes et al. | 166/84.3 |
| 7,431,351 | B2 | * | 10/2008 | Russell | 285/381.1 |
| 7,513,537 | B2 | * | 4/2009 | Mosing et al. | 285/401 |
| 2001/0011592 | A1 | * | 8/2001 | Baker | 166/339 |

FOREIGN PATENT DOCUMENTS

| | | |
|---|---|---|
| FR | 2664672 | 1/1992 |
| GB | 2114630 | 8/1983 |
| GB | 2293185 | 3/1996 |

* cited by examiner

LOCKING DEVICE

CROSS-REFERENCE TO RELATED APPLICATION

The present application claims priority to PCT/EP2004/011246 filed 12 Oct. 2004 hereby incorporated herein by reference.

BACKGROUND OF THE INVENTION

The invention refers to a locking device for locking an exchangeable unit in an insertion opening of an associated housing, particularly in the maritime extraction of mineral oil or mineral gas, comprising locking elements adjustable between an insertion position and a locking position, wherein in the insertion position the unit can be inserted into the insertion opening and is locked in the locking position within the insertion opening and/or relative to the housing.

Locking devices of this kind serve for the simple assembly and disassembly of the respective unit for instance to replace this unit by another unit on the spot. Units of this type are for instance tubes, valve units, throttle units or other actuator units, which are inserted on the spot into the respective insertion opening of the housing. The housing may be integrated in a so-called tree on the seabed or it may be detachable from the tree as part of the tree. The unit is usually conveyed to the housing by a remote-controlled vehicle and is inserted there into the insertion opening and subsequently fixed by means of the locking device.

A locking device is for instance known from practice, in which respective locking elements are adjustably arranged in an actuator unit between an insertion position and a locking position. In the insertion position of the locking elements, the locking elements are substantially retracted into the actuator unit and do not project over the circumferential surface of the actuator unit, if the actuator unit is inserted into the housing, the respective fixing is implemented by pivoting out the locking elements in their locking position. The insertion opening comprises in this connection respective recesses into which the locking elements particularly pivot with free ends and thereby effect a fixing of the actuator unit in the housing.

Such a locking device operates fully satisfactorily with respect to the insertion and locking of the respective unit in the housing. However, the constructive effort of the arrangement of the locking elements and their operation is relatively high and requires very specific constructional modifications of the unit. Since the locking elements are displaceably supported on the unit, damage during transport of the unit to the place of installation may occur. Furthermore, respective sealing measures of the unit are required in the area of the locking elements, which for instance are achieved by additional seals and/or enlarged dimensions of the unit and thus also of the housing.

BRIEF SUMMARY OF THE PREFERRED EMBODIMENTS

The object of the invention is to improve a locking device of the above-mentioned kind in that this locking device has a more simple construction and can at the same time be operated more easily by keeping the safe sealing between the unit and the housing.

This object is solved by a locking device for locking an exchangeable unit in an insertion opening of an associated housing, particularly in maritime mineral oil and mineral gas extraction, comprising locking elements adjustable between an insertion position and a locking position, wherein in the insertion position of the locking elements the unit can be inserted into the insertion opening and is locked in the locking position within the insertion opening and relative to the housing, characterized in that the locking elements are formed as thread segments spaced apart by insertion gaps in the circumferential direction and are arranged on the outside of the actuator unit and assigned to the insertion opening, said thread segments being arranged in the insertion direction at a gap and being in thread engagement in the locking position.

According to the invention, the locking elements are formed as thread segments. A part of the thread segments is arranged on the outside of the unit. A further part of the thread segments is associated to the insertion opening. The thread segments are arranged at a spacing to each other by insertion gaps in the circumferential direction. The insertion of the unit is implemented in the insertion position of the thread segments, wherein the thread segments are arranged relative with respect to each other at a gap. If the unit is sufficiently far inserted into the insertion opening, a torsion of the respective thread segments relative to one another takes place so that these segments are in threaded engagement in their locking position.

By forming the locking elements as thread segments, a pivoting of respective locking elements is not required and particularly no arrangement and movability of such locking elements on or relative to the unit. Thus, the unit may have a simpler structure and may not reveal the above-mentioned disadvantages.

The formation of the locking elements as thread segments also leads to the fact that these thread segments simply press the unit into the insertion opening by a twisting between the insertion position and the locking position to improve sealing.

The respective thread segments can easily be manufactured as an integrated part of the unit or possibly also as a part detachably attached on the outside of this unit. This analogously applies to the thread segments associated to the insertion opening. These thread segments may for instance be integrated within the insertion opening or they may detachably be attached as a ring element or the like in this insertion opening. The thread segments may also be attached separately on an end of the insertion opening. These thread segments may for instance be integrated within the insertion opening or they may be detachably attached in this opening as an annular element or the like. The thread segments may also be attached separately on an end of the insertion opening.

Particularly when using the locking device in the extraction and production of mineral oil or mineral gas, very high pressures occur in the respective units and housings. In order to be able to use the locking device with these high pressures, the possibility exists to arrange at least two rows of thread segments on the unit and/or the insertion opening.

Basically, the possibility exists to form the thread segments and the respective insertion gaps in the circumferential direction in different lengths. In order to simplify the construction and possibly also the insertion of the unit, the thread segments may be equally long and/or equally spaced apart in the circumferential direction.

In an embodiment a segment row may comprise three thread segments and three insertion gaps each. These are all equally long and extend over a circumferential angle of 60°. Thus, principally three different alignment positions of the unit exist in which they are insertable into the insertion opening. Subsequently an only slight twisting of the thread segments relative to one another in their locking position takes place to fix the unit within the insertion opening and relative to the housing.

In order not to excessively strain the unit during twisting of the thread segments between the insertion position and the locking position and in order not to have to handle these segments directly, the thread segments associated to the insertion opening may be pivoted relative to the insertion opening. That means that the unit is inserted into the insertion opening and subsequently the thread segments associated with the insertion opening are twisted so that a further handling of the unit for the purpose of locking is not required.

In a simple embodiment for twisting the thread segments, a rotating sleeve can be pivoted relative to the housing, and the thread segments associated to the insertion opening may be arranged particularly on its inner side.

The possibility exists that the rotary sleeve is directly supported on the housing and is operated there for instance by a remote-controlled vehicle or tool. In another embodiment, the rotary sleeve may be pivoted in a flange housing connected to the housing particularly detachably, wherein the insertion opening is formed by a housing opening and an inner opening of the flange housing continuing this opening in order to receive the unit. Thus, the rotary sleeve can easily be exchanged in that the flange housing is released from the housing and is replaced for instance by another flange housing.

The flange housing may form part of the overall housing in that for instance an actuator unit can be used as a unit with an actuator end and a drive end formed with relatively enlarged dimensions. In order to be able to receive such an actuator unit in a simple manner, an annular surface can be formed between the housing opening and the inner opening, said annular surface extending substantially radially outwardly. Thus, the housing opening has smaller dimensions than the inner opening and the actuator unit is inserted into the different openings with its respective portions.

Since the actual control unit of the actuator means is arranged in the actuator end, which is inserted into the housing opening and a respective sealing is required in this area, sealing elements for sealing between the inner opening wall and the circumferential surface of the actuator unit may be arranged at least within the housing opening.

In order to be able to pivot the rotary sleeve in the flange housing in a simple manner, the flange housing may have an annular space in which the rotary sleeve is rotatably supported by means of bearing means. Respective bearing means may be provided for the axial and for the radial support of the rotary sleeve.

A simple possibility of engaging the different thread segments with one another can be seen in that the annular space is provided with a segment opening from which the thread segments of the rotary sleeve project in the direction towards the thread segments.

A simply structured flange housing may be formed by inner and outer housing portions having a substantially L-shaped cross section which border the annular space. The longer L-leg of the different housing portions forms an inner or outer wall of the flange housing and the shorter L-legs form the connection walls between these walls. The respective segment opening may be formed in the longer L-leg of the inner housing portion and for instance between the free end of the longer L-leg of the inner housing portion and the free end of the shorter L-leg of the outer housing portion.

In order to prevent the different thread segments in the insertion position from contacting each other when inserting the unit, the inner housing portion may at least have an alignment means for the aligned insertion of the unit into the housing opening.

A simple embodiment for such an alignment means may be that the alignment means is formed as an alignment groove into which a guide projection outwardly projecting from the unit can be inserted and which is subsequently guided.

In order to improve in this connection the allocation of alignment groove and guide projection when inserting the unit, the alignment groove and/or the guide projection may comprise insertion aiding surfaces running towards each other obliquely in the insertion direction. Thus, a somewhat more precise allocation of unit and housing is possible, which is automatically improved by the insertion aiding surfaces and which is subsequently maintained by the engagement of the guide projection and the alignment groove.

The possibility exists to rotate the rotary sleeve by direct outer engagement and to thereby twist it by locking elements between the insertion position and the locking position. In order to not excessively strain the rotary sleeve and to simultaneously simplify its rotation, a drive means operable from the outside for a remote-controlled vehicle or tool to rotate the rotary sleeve can be assigned to the rotary sleeve.

It must be noted that the possibility also exists to operate such a drive means in a remote-controlled manner, wherein this means is operated for instance hydraulically, pneumatically or electrically.

A drive means, which can well be controlled and monitored, may for instance be a thread drive.

An example for such a thread drive is a worm gear, which may be formed as a cylinder worm gear, spur gear or also as a double enveloping worm gear.

The thread drive may, however also comprise a spur gear arranged on a rotary shaft, the spur gear being in engagement with a respective outer teeth of the rotary sleeve.

In order to prevent the unit from possibly being unlocked automatically at least partially, the drive means can be formed in a self-inhibiting manner.

In order to safely displace the unit into a respective sealing seat within the housing when adjusting the locking elements between the insertion position and the locking position, at least one thread segment may extend in a bevelled manner in the direction towards the housing. The bevel may for instance be between 10° and 30° and preferably between 15 and 20°. Such a bevel is sufficient to bring the unit into contact with the respective sealing element when twisting the rotary sleeve.

In order not to have to release the entire flange housing from the housing for the purpose of a maintenance, the rotary sleeve and/or the outer housing portion may be exchangeable with the drive means. That means that the outer housing portion with the drive means may be released and thereupon the rotary sleeve is accessible or also removable whereas the inner housing portion is further attached at the remaining housing.

In an embodiment, the drive means may be integrated in the outer housing portion. This may apply when using a worm gear.

However, the possibility also exists that the drive means is releasably attached at the outer housing portion and comprises a drive housing of its own. In order to establish the drive connection between the drive means and the rotary sleeve, the outer housing portion may comprise a respective opening.

In order to be able to operate in a simple manner the drive means from the outside by a remote-controlled vehicle, a remote-controlled tool or also a diver or the like, an operating adapter may be associated to the drive means.

As already indicated, the possibility exists that the flange housing may also form the housing itself, wherein the insertion opening is formed by the respective inner opening of the flange housing. The flange housing may otherwise be connected to other means of a tree or the like, or it may be provided at other means of the maritime mineral oil and gas extraction and production. As already mentioned, a respective unit may also be substantially tubular, wherein the locking means may also be attached in the area of a pipeline at respective means to lock such a tubular unit and to possibly also hold it.

BRIEF DESCRIPTION OF THE DRAWINGS

Advantageous embodiments of the invention are explained closer by means of the Figures enclosed in the drawing.

DETAILED DESCRIPTION OF THE PREFERRED EMBODIMENTS

Figure 1:
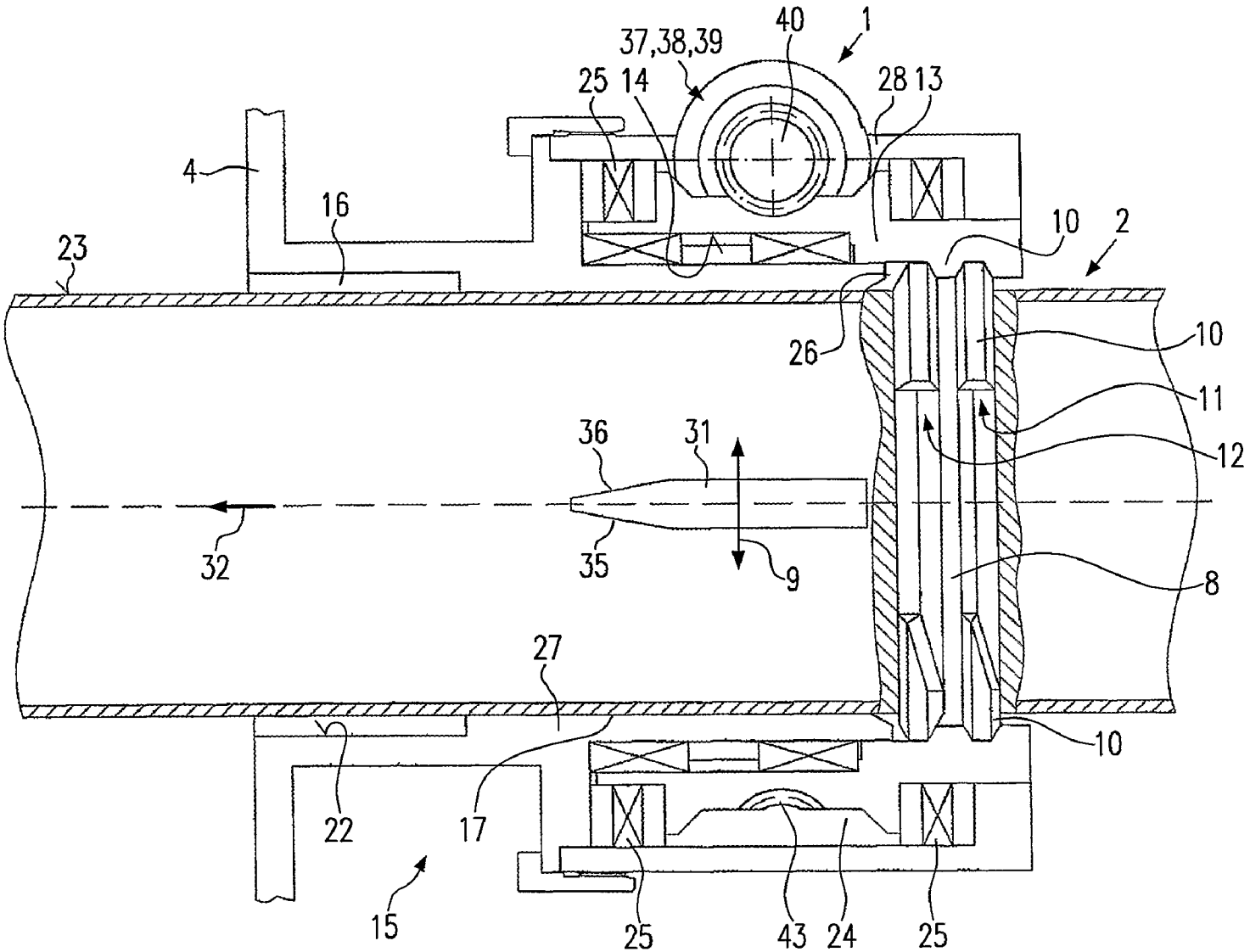
FIG. 1 shows a longitudinal section through a first embodiment of a locking device at a housing for locking a unit in the housing.
Figure 2:
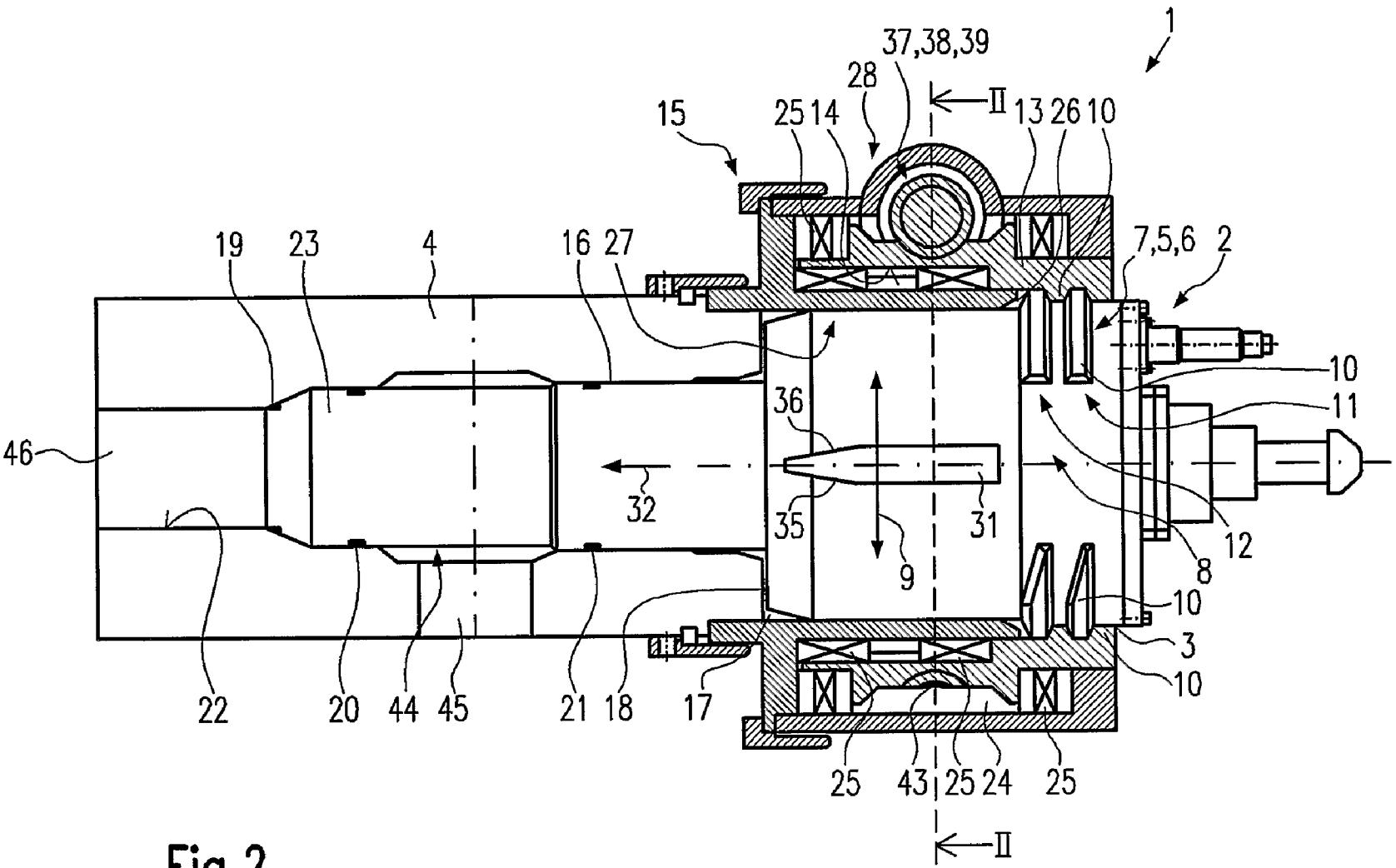
FIG. 2 shows a longitudinal section analogue to FIG. 1 through a second embodiment with a unit formed as an actuator unit.

FIGS. 1 and 2 each show a longitudinal section through a first and second embodiment of a locking device according to the invention. In FIG. 1 a substantially tubular unit 2 and in FIG. 2 a unit formed as an actuator unit 2 is used. In these Figures as well as in the remaining Figures identical members are designated by identical reference numerals. The description is partially only made in connection with a Figure, wherein the description of FIGS. 1 and 2 is basically made identically.

FIG. 1 and FIG. 2 shows a longitudinal cut through a locking device 1 for locking a unit 2 and actuator unit 2 in a housing 4.

Such a housing 4 may be part of a so-called tree, which is for instance arranged on the bottom of the sea and which serves for extracting mineral oil or gas. The housing may be an integrated part of the tree or it may releasably be attached thereon.

The actuator unit 2 usually serves for controlling a flow e.g. of mineral oil or mineral gas, wherein the actuator unit 2 shown is a throttle unit. This unit comprises for instance a rotary throttle element 44, which varies the flow surface between an inlet 45 and an outlet 46 of the housing 4 to control the fluid flow. The rotation of the throttle element 44 is implemented by a drive means arranged within the actuator unit 2. This means is particularly formed as an electric drive means, which comprises at least one electric actuator motor, a respective drive unit and usually a thread drive with a spindle and spindle nut.

The unit 2 in FIGS. 1 and 2 is already fully inserted into a respective insertion opening 3 of the housing 4 and locked there by means of the locking device 1. The insertion opening 3 comprises a housing opening 16 and an inner opening 17 of a flange housing 15. The housing opening 16 extends in the longitudinal direction of the housing 4, and the inlet 45 opens into this housing, see FIG. 2, and the outlet 46 is arranged in the extension of the opening. A substantially radially outwardly extending annular face 18 is formed between the housing opening 16 and the inner opening 17. This annular surface is restricted outwardly by the flange housing 15, which forms part of the locking device 1.

The flange housing 15 is detachably attached at the remaining housing 4 (FIG. 2) or part of the housing 4 and has an L-shaped interior and an L-shaped exterior housing portions 27, 28. The housing portions are connected to one another, wherein an annular segment opening 26 is formed between a free end of a longer L-leg of the inner housing portion 27 and a free end of the shorter L-leg of the outer housing portion 28. The inner housing portion encompasses the inner opening 17 and is set onto an annular recess of the housing 4 at one end. An annular space 24 is formed between the inner and the outer housing portions 27, 28. In this annular space a rotary sleeve 13 is pivoted by means of a number of bearing means 25 in the form of radial and axial bearings. The rotary sleeve comprises a number of thread segments 10 as locking elements 7 on its inner side 14 facing the inner opening 17. These thread segments project from the segment opening 26. The respective thread segments 10 are arranged in two segment rows 11, 12 and engage respective thread segments 10 on the outer side of the actuator unit 2. These segments are also arranged in two respective rows of segments 11, 12.

The different segment rows 11, 12 are substantially arranged in the circumferential direction 9, wherein an insertion gap 8 is formed between adjoining thread segments 10. The insertion gaps and the thread segments extend across identical lengths in the circumferential direction. The relative arrangement of the different thread segments 10 shown in FIGS. 1 and 2 corresponds to their locking position in which the different thread segments are in engagement in a manner that the unit 2 is locked in the housing 4 with the flange housing 15 and according to FIG. 2 is arranged in a sealed manner particularly between the opening wall 22 of the housing opening 16 and the circumferential surface 23 of the actuator unit 2 by the respective sealing element 19, 20, 21.

Figure 3:
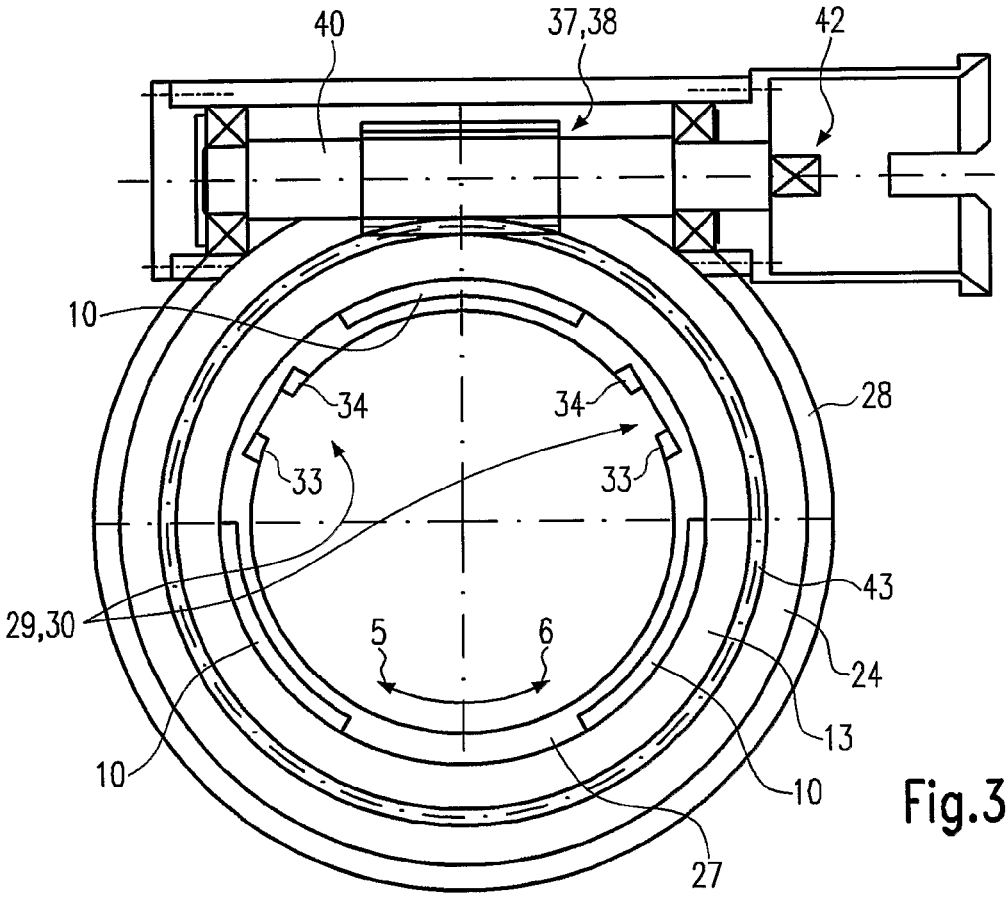
FIG. 3 shows a section along line II-II of FIG. 2.

By twisting the rotary sleeve 13 by means of a respective drive means 37, the different thread segments of the segment rows 11, 12 are twistable relative to one another to such an extent that the thread segments 10 of the rotary sleeve 13 are arranged at a gap to the thread segments 10 of the unit 2 and in this insertion position, also see FIG. 3, of the thread segments 10 the unit 2 can either be inserted into the insertion opening or it can be retracted therefrom.

The drive means 37 associated to the rotary sleeve 3 to the twisting thereof is formed as a self-inhibiting thread drive 38 e.g. in the form of a worm drive 39. An outer toothing 43 is formed in an outer circumferential surface of the rotary sleeve 13, said outer toothing being in drive connection with a respective worm, also see FIG. 3.

The various thread segments 10 may extend in an oblique manner in the direction towards the housing 4 according to an embodiment according to the invention.

In order to obtain a precise allocation of unit 2 and insertion opening 3 when inserting the unit in the insertion direction 32 and the thread segments 10 in the insertion position 5, the inner housing portion 27 has an alignment means 29 in the form of an alignment groove extending in the insertion direction 32, also see FIG. 3. With this alignment groove a guide projection 31 radially projecting outwardly from the unit 2 during insertion of the unit 2 into the insertion opening 3 is engaged and is subsequently guided along the alignment groove 30.

The alignment groove as well as the guide projection comprise on their ends facing the housing 4 insertion aiding surfaces 33, 34 and 35, 26 obliquely running towards each other also see FIG. 3.

FIG. 3 shows a cut along line II-II of FIG. 2. In this Figure the alignment grooves 30 with respective insertion aiding surfaces 33, 34 can be seen, which serve for accommodation and for the subsequent guiding of the guiding projection 31, see FIGS. 1 and 2. In this case, two respective alignment grooves and guide projections are arranged.

The thread segments 10 on the inner side of the rotary sleeve 13 are arranged such that they extend across a central angle of approximately 60° and the insertion gaps 8 formed between adjoining thread segments 10 also extend across a central angle of approximately 60°. This analogously applies to the thread segments 10 of a further row of segments or also for the thread segments 10 of the rows of segments 11 and 12 on the outside of the actuator unit 2, see FIGS. 1 and 2.

It is also indicated in FIG. 3 that by twisting the rotary sleeve 13 the respective thread segments 10 or insertion gaps 8 are twistable between an insertion position 5 and a locking position. The drive means 37 consisting of rotary shaft 40 worm on the rotary shaft and rotary sleeve 13 with a respective outer toothing serves for this twisting.

The rotary shaft 40 is arranged transversely to the longitudinal axis of the rotary sleeve and provided with an operating adapter 42 on one side. This adapter serves for engagement of a remote-controlled vehicle, tool or for a diver or the like in order to analogously twist the rotary sleeve 13 and thus the respective thread segments 10 between the insertion position and the locking position 5, 6 by twisting the rotary shaft 40 and the associated worm.

In the embodiment according to FIG. 3 the drive means 37 is substantially integrated in the outer housing portion 28 and forms a portion outwardly projecting over this housing portion.

Figure 4:
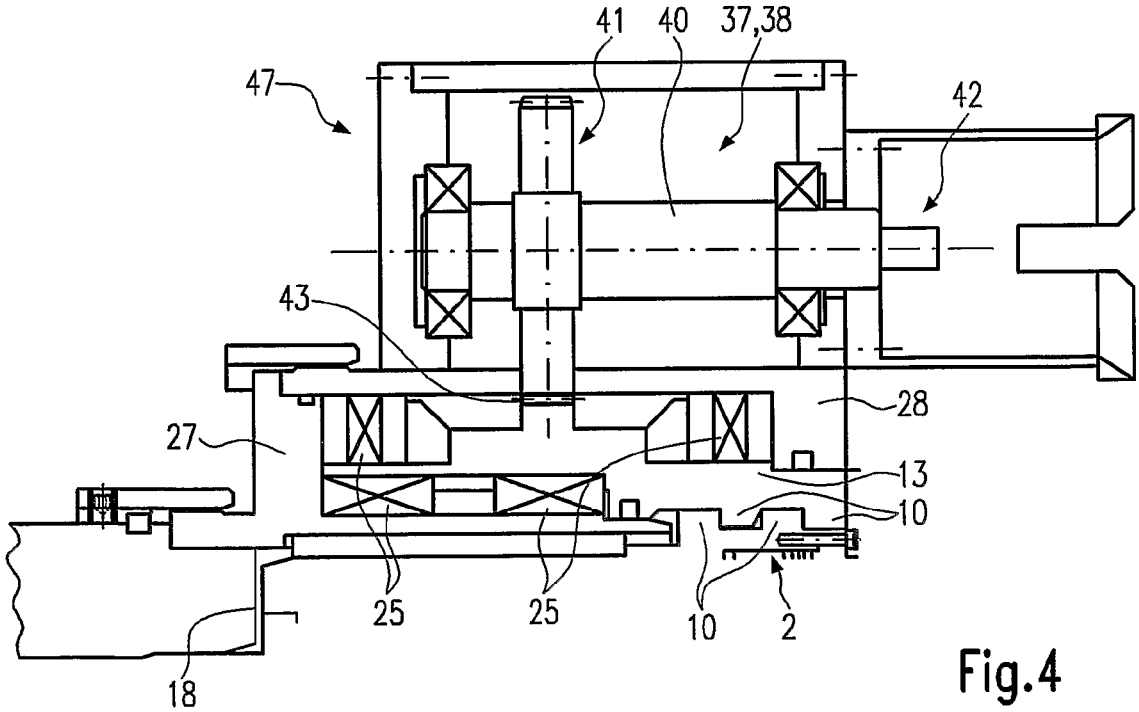
FIG. 4 shows a cut analogue to FIG. 1 or 2 in enlarged view for a second embodiment of a locking device according to the invention.

In the embodiment according to FIG. 4 the drive means 37 is arranged substantially outside of the outer housing portion 28 and comprises a drive housing portion 47 of its own.

Except for the other drive means, the separate drive housing and a slightly modified rotary sleeve 13, the embodiments according to FIGS. 1 to 4 correspond to each other, and reference is made to the description with respect to FIGS. 1 to 3.

Contrary to the above-mentioned embodiment, a spur gear 41 with an outer toothing is arranged on the rotary shaft 40 in the embodiment according to FIG. 4. This spur gear engages an opening in the outer housing portion 28 and is in engagement with the outer teeth 43 of the rotary sleeve.

The arrangement of the respective thread segments 10 and the alignment means 29 and the remaining features of the locking device and of the housing 4 correspond to those of the first embodiment.

The function of the locking device according to the invention will now be described by means of the Figures.

In the case of thread segments 10 of rotary sleeve 13 and unit 2 in the insertion position 5, the unit may be inserted into the respective insertion opening 3 by means of a remote-controlled vehicle or the like. A relative alignment of unit 2 and insertion opening 3 and housing 4 is implemented through the alignment means 29, as described above. If the unit 2 is inserted into the insertion opening 3 to such an extent that the thread segments 10 can be engaged with each other by rotating the rotary sleeve 3, an operation of the drive unit 37 takes place in that a remote-controlled vehicle or the like rotates the rotary shaft 40 via an operating adapter, and thus rotates the worm and the spur gear. These are in engagement with the outer toothing 43 of the rotary sleeve 13 so that this sleeve is rotated analogously together with its thread segments 10 in rows of segments 11 and 12. By adjusting the thread segments 10 of the rotary sleeve 13 in the locking position 6, the unit 2 is on the one hand locked within the insertion opening 3, see FIGS. 1 and 2, and on the other hand it is pressed in the direction towards the sealing elements 19, 20, 21 for correct sealing within the housing opening 16, see FIG. 2.

The locking means according to the invention may withstand high pressures within the unit and the housing without an unlocking taking place. The twisting of the rotary sleeve and thus of the respective thread segments is usually 60° at most. Thus, only a minor operation of the respective drive means is required. The drive means is also formed in a self-inhibiting manner so that an automatic unlocking cannot take place. Instead, the respective rotary sleeve with its thread segments must be rotated back in reversed direction about a respective angle for the purpose of unlocking, so that the thread segments of the unit and rotary sleeve are arranged with a gap and subsequently the unit can be drawn out of the housing. Due to the use of the specific drive means and the respective locking elements with a possibly bevelled extension, only small forces are required when operating the drive means by a remote-controlled vehicle or the like, in order to twist the rotary sleeve by means of the drive means and in order to move the locked engagement into the different thread segments. This applies analogously to the twisting of the locking elements in the insertion position.

The invention claimed is:

1. A locking device for a subsea housing having an insertion opening, comprising:

a unit having at least a portion receivable within the insertion opening;

a rotary sleeve being rotatable in a flange housing detachably connected to the subsea housing, wherein the insertion opening is formed by a housing opening and an inner opening of the flange housing to receive the unit;

locking elements adjustable between an insertion position and a locking position, wherein in the insertion position, the unit can be inserted into and removed from the insertion opening and in the locking position, the unit can be locked relative to the housing;

the locking elements including first thread segments spaced apart by insertion gaps in a circumferential direction and arranged on the outside of the unit and alignable with the insertion opening;

second thread segments arranged on an inner side of the rotary sleeve rotatable relative to the housing;

the first thread segments being arranged in an insertion direction at a gap between the second thread segments and the first and second thread segments being in thread engagement in the locking position; and drive means to rotate the rotary sleeve and the second thread segments less than a full rotation into engagement with the first thread segments to the locking position, wherein rotation of the rotary sleeve back to the insertion position allows for removal of the unit without further disassembly, wherein the unit and the housing comprise alignment members to align the thread segments and gaps prior to the thread segments being wherein the alignment members substantially prevent rotation of the unit during rotation of the rotary sleeve.

2. A locking device as claimed in claim 1, characterized in that at least two rows of thread segments are arranged on the unit and are alignable with the insertion opening.

3. A locking device as claimed in claim 1, characterized in that the thread segments are equally long and equally spaced in the circumferential direction and extend across a central angle of 60 degrees.

4. A locking device as claimed in claim 2, characterized in that a row of thread segments includes three thread segments and three insertion gaps and the alignment members include a guide projection and groove surfaces.

5. A locking device as claimed in claim 1, characterized in that the second thread segments are detachably attached on an annular element in the insertion opening.

6. A locking device as claimed in claim 1, characterized in that the housing can be oriented to provide an annular space that provides means for the rotary sleeve to pivot in an axial manner.

7. A locking device as claimed in claim 6, characterized in that the housing and the unit include sealing elements on annular faces for sealing engagement.

8. A locking device as claimed in claim 1 characterized in that a substantially radially outwardly extending annular face is formed between the housing opening and the inner opening with the housing opening extending beyond the annular face.

9. A locking device as claimed in claim 8 characterized in that sealing elements sealing between the inner opening wall and the circumferential surface of the unit are arranged at least within that portion of the housing opening extending beyond the annular face.

10. A locking device as claimed in claim 7 characterized in that the flange housing has an annular space in which the rotary sleeve is supported by means of bearing means and is pivotable in an axial manner.

11. A locking device as claimed in claim 10 characterized in that the annular space comprises a segment opening from which the second thread segments of the rotary sleeve project in the direction of the first thread segments of the unit.

12. A locking device as claimed in claim 10 characterized in that the annular space is bordered by inner and outer housing portions of the flange housing, said housing portions being L-shaped at least in cross section.

13. A locking device as claimed in claim 1 characterized in that the drive means is accessible from the outside for a remote-controlled vehicle or tool for rotating the rotary sleeve.

14. A locking device as claimed in claim 13 characterized in that the drive means is a thread drive having a worm gear for rotating the rotary sleeve that rotates the second threads.

15. A locking device as claimed in claim 1 characterized in that the threads are perpendicular to the axis of the subsea housing and at least one thread segments includes a beveled end in the direction towards the subsea housing.

16. A locking device as claimed in claim 13 characterized in that at least one of the rotary sleeve and the outer housing portion with the drive means are exchangeable.

17. A locking device as claimed in claim 13 characterized in that the drive means is integrated in an outer housing portion with the unit being received within the drive means.

18. A locking device as claimed in claim 13 characterized in that an operating adapter particularly for a remote-controlled vehicle or tool is associated with the drive means.

19. A locking device as claimed in claim 7 characterized in that the flange housing is formed integrally with the remaining subsea housing.

20. A locking device as claimed in claim 19 characterized in that the subsea housing is formed by the flange housing and the insertion opening through an inner opening.

21. An apparatus for attaching a throttle unit to a Christmas tree for controlling flow through a tree aperture in the Christmas tree for the production of oil or gas, the apparatus comprising:

a housing connected to the Christmas tree and having an insertion opening aligned with the tree aperture, the housing having rotatable, radially projecting inward segments forming inward circumferential spaces between the inward segments;

an actuator having a first portion insertable through the insertion opening and into the tree aperture and a second portion insertable only into the insertion opening, the actuator having radially projecting outward segments around the second portion forming outward circumferential spaces between the outward segments;

the outward segments passing through the inward spaces and the inward segments passing through the outward spaces in an insertion position;

the housing including a drive to rotate the inward segments circumferentially less than a full rotation to align the inward segments with the outward segments to a locking position to lock the actuator in the housing and tree, wherein rotation of the inward segments back to the insertion position allows for removal of the actuator without further disassembly; and the first portion varying a flow surface through the tree aperture, wherein the housing and actuator include alignment members to align the outward segments through the inward spaces and the inward segments through the outward spaces in an insertion position, and wherein the alignment members substantially prevent rotation of the actuator during rotation of the inward segments.

22. The apparatus claimed in claim 21 wherein the drive includes a gear and a drive means to selectively drive the gear engaging a sleeve to rotate the sleeve having the inward segments.

23. The apparatus claimed in claim 21 wherein the inward and outward segments have more than one row of segments, the segments being perpendicular to a longitudinal axis of the housing.

24. An apparatus for a Christmas tree having a tree aperture communicating with a fluid flow path, the apparatus comprising:

a housing connected to the Christmas tree and having an insertion opening aligned with the tree aperture, the housing having a rotary sleeve with radially projecting inward segments forming inward circumferential spaces between the inward segments;

an actuator having an element insertable through the insertion opening and into the tree aperture to vary flow through the fluid flow path, the actuator having radially projecting outward segments forming outward circumferential spaces between the outward segments;

the outward segments passing through the inward spaces and the inward segments passing through the outward spaces in an insertion position; and the housing including a gear to rotate the rotary sleeve circumferentially less than a full rotation to align the inward segments with the outward segments to a locking position to lock the actuator in the housing and tree, wherein rotation of the rotary sleeve back to the insertion position allows for removal of the actuator without further disassembly, wherein the housing and actuator include alignment members to align the outward segments through the inward spaces and the inward segments through the outward spaces in an insertion position, and wherein the alignment members substantially prevent rotation of the actuator during rotation of the rotary sleeve.

* * * * *